US006685430B2

(12) United States Patent
Chapman

(10) Patent No.: US 6,685,430 B2
(45) Date of Patent: Feb. 3, 2004

(54) COMPACT CENTRIFUGAL BLOWER WITH ANNULAR STATOR

(75) Inventor: Thomas Chapman, Templeton, MA (US)

(73) Assignee: Robert Bosch Corporation, Waltham, MA (US)

( * ) Notice: Subject to any disclaimer, the term of this patent is extended or adjusted under 35 U.S.C. 154(b) by 0 days.

(21) Appl. No.: 10/092,206

(22) Filed: Mar. 5, 2002

(65) Prior Publication Data

US 2002/0136634 A1 Sep. 26, 2002

Related U.S. Application Data

(60) Provisional application No. 60/273,613, filed on Mar. 5, 2001.

(51) Int. Cl.[7] ..... F04D 29/44

(52) U.S. Cl. ..... 415/208.2; 415/211.2; 416/185; 416/189; 416/243

(58) Field of Search ..... 415/206, 211.2, 415/208.2; 416/185, 189, 241 A, 223 B, 243

(56) References Cited

U.S. PATENT DOCUMENTS

| | | | | |
|---|---|---|---|---|
| 7,883 A | | 1/1851 | Bennet | |
| 3,289,920 A | | 12/1966 | Boivie | |
| 3,597,117 A | * | 8/1971 | Zoehfeld | 417/354 |
| 4,900,228 A | | 2/1990 | Yapp | |
| 4,946,348 A | | 8/1990 | Yapp | |
| 5,743,710 A | | 4/1998 | Yapp | |
| 6,045,327 A | | 4/2000 | Amr | |
| 6,224,335 B1 | * | 5/2001 | Parisi et al. | 415/206 |
| 6,278,207 B1 | * | 8/2001 | Matsumoto | 310/88 |
| 6,299,409 B1 | * | 10/2001 | Matsunaga et al. | 415/206 |

FOREIGN PATENT DOCUMENTS

| | | | | |
|---|---|---|---|---|
| GB | 2080879 A | * | 2/1982 | F04D/29/44 |
| GB | 2166494 A | * | 5/1986 | F04D/29/44 |
| JP | 62-29799 | | 2/1987 | |

* cited by examiner

*Primary Examiner*—Ninh H. Nguyen
(74) *Attorney, Agent, or Firm*—Fish & Richardson, P.C.

(57) ABSTRACT

This invention is characterized by a very compact blower assembly architecture designed to operate at low Reynolds numbers. The assembly includes an impeller with forward-curved blades and a hub that is shaped to minimize the overall package volume of the assembly. The impeller is driven by a low-power, brushed, direct-current motor. A shroud part includes a generally cylindrical inlet that directs the air into the impeller, and a surface that forces the air leaving the impeller to turn from a generally radial and tangential direction to a generally axial and tangential direction. The shroud part directs the air into a single stage of stator blades that reduces the tangential component of the air velocity and produces a static pressure rise.

10 Claims, 4 Drawing Sheets

COMPACT CENTRIFUGAL BLOWER WITH ANNULAR STATOR

RELATED APPLICATION

Pursuant to 35 U.S.C. §119, this application claims the benefit of the filing date of U.S. Ser. No. 60/273,613, filed Mar. 5, 2001.

FIELD OF THE INVENTION

This invention in the general field of centrifugal blowers, particularly plastic injection-molded blowers such as those used to cool electronics in automotive applications.

BACKGROUND

Automotive electronics are often placed in areas of high ambient temperature, such as vehicle engine compartments. In order to assure that electronics remain within their design temperature limits, small centrifugal blowers are sometimes used to provide cooling. Because space is limited, these blowers must be extremely compact. In the interest of compactness, these blowers sometimes utilize an annular stator instead of a volute. A problem with this configuration, however, is that it is often inefficient when used in small, low power blowers. Another problem is that it is difficult to take advantage of the improved packaging efficiency of this configuration when using extremely inexpensive, low-power, mechanically-commutated (brushed) motors, which have a length significantly greater than their diameter. Electronically-commutated (brushless) motors are shorter, and can allow the overall blower dimensions to be reduced, but typically are significantly more expensive.

Centrifugal blowers usually employ volutes to collect the flow leaving the impeller blades and direct flow into a duct that carries the flow downstream. The direction of the flow exiting the blower is turned (e.g. generally on the order of 90°) from the direction of the flow upstream of the blower. In some cases, however, centrifugal blowers employ an annular stator that directs the flow from the impeller blades by turning the flow from a generally radial and tangential direction to a generally axial and tangential direction, thereby producing flow downstream of the blower that is generally in the same direction as that upstream of the blower. Typically the annular stator includes stator blades which reduce the tangential component of velocity. This design is best suited for reasonably large, high-power blowers, which operate at high Reynolds number, as explained below.

The blade chord Reynolds number ("Reynolds number" or simply "Re") is a non-dimensional parameter that is a measure of the relative effects of inertial forces and viscous forces in a fluid. Reynolds number is defined by the following equation:

$$Re=\rho UL/\mu$$

where $\rho$ is the fluid density, U is a characteristic velocity, L is a characteristic length, and $\mu$ is the fluid viscosity. A small Reynolds number indicates that viscous forces dominate the behavior of a fluid, whereas a large Reynolds number indicates that inertial forces dominate the behavior of a fluid. The shapes of the impeller and stator blades are likely to differ depending on the magnitude of the Reynolds number associated with the flow conditions of the design application.

One design characteristic of centrifugal impellers is the blade curvature—i.e. either forward-curved or backward-curved. Centrifugal blowers utilizing annular stators often use backward-curved impellers. Backward-curved impellers have a high degree of reaction—that is, there is a significant pressure rise within the impeller blading. In order to develop this pressure, the flow must remain largely attached to the blades. This can be achieved when the Reynolds number is high, but is more difficult at low Reynolds numbers—that is, when the impeller is small, or when the rotation speed is low. Forward-curved blades have a low degree of reaction, and do not require large Reynolds numbers to work effectively.

Centrifugal blowers with annular stators often have a two-stage stator design, where one cascade of stator blades is located behind another. An advantage of this design is that one can increase the solidity of the second stator stage, due to the fact that the flow has been turned significantly by the first stator stage. This type of stator tends to work well at large Reynolds numbers. At low Reynolds numbers, however, the amount of flow turning that can be achieved is much less, so there is less to be gained by a two-stage stator. In fact, the stator blades in the two-stage design are likely to have short chords to reduce overall package size, thus reducing the Reynolds number even further. This is another possible source of inefficiency for small, low-power, centrifugal blowers incorporating annular stators Yapp, U.S. Pat. No. 4,900,228 discloses a centrifugal blower with backward-curved blades having an "S" shaped camber. The blower employs an annular two-stage stator.

Yapp, U.S. Pat. No. 4,946,348 discloses a centrifugal blower with backward-curved blades. The blower employs an annular two-stage stator.

Yapp, U.S. Pat. No. 5,743,710 discloses a centrifugal blower that employs an annular two-stage stator.

SUMMARY

This invention features a very compact blower assembly architecture that performs well at small blower diameters and with low-powered motors—conditions which tend to result in low Reynolds numbers. The blower assembly includes an impeller with forward-curved blades and a hub that is shaped to minimize the overall package volume of the assembly by covering at least 30% of the axial extent of the motor. The blower assembly also comprises a shroud comprising: i) a generally cylindrical inlet which directs the air into the impeller, and ii) a surface which directs the air leaving the impeller into a stator, turning it from a generally radial and tangential direction to a generally axial and tangential direction. The stator includes an annular region with a single stage of stator blades that reduce the tangential component of the velocity of the air entering the stator and produce a static pressure rise. The stator blade diameter is less than 150 millimeters and the stator chord lengths are at least 15% of the stator blade diameter. Input motor power is less than 25 watts.

In preferred embodiments, the blower assembly is characterized by:

a) a brushed (mechanically-commutated) direct-current motor with an input power of less than 10 watts, and, most preferably, less than 5 watts;

b) a stator blade diameter less than 90 millimeters;

c) stator blade chord lengths greater than 20% of the stator blade diameter;

d) a stator comprising features to hold the drive motor without the use of separate fasteners;

e) an impeller, stator, and shroud constructed from injection-molded plastic; and f) a size and design suited to the cooling of electronic components, most preferably those positioned in the engine compartment of a vehicle.

The details of one or more embodiments of the invention are set forth in the accompanying drawings and the description below. Other features, objects, and advantages of the invention will be apparent from the description and drawings, and from the claims.

DETAILED DESCRIPTION

Figure 1A:
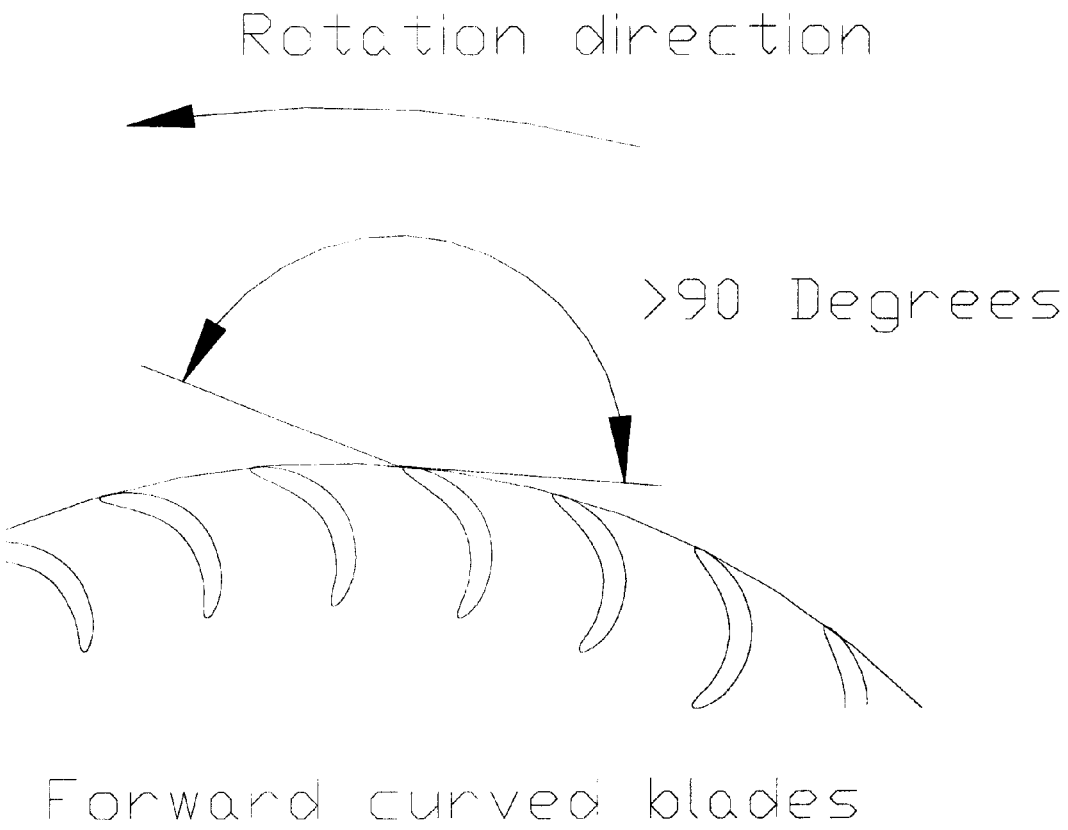
FIGS. 1A and 1B are cross sectional views of two types of impeller blades, illustrating the difference in trailing edge angles between forward-curved and backward-curved impeller blades.
Figure 1B:
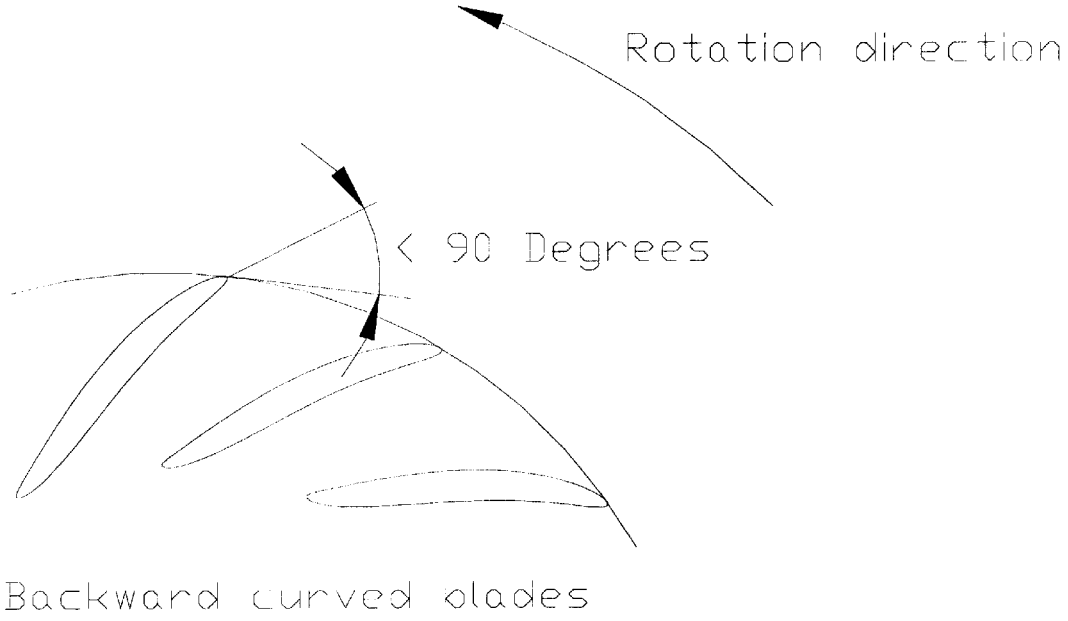

FIGS. 1A and 1B are cross section views of two types of impeller blades, illustrating the difference in trailing edge angles between forward-curved (FIG. 1A) and backward-curved (FIG. 1B) impeller blades. A basic design feature of a centrifugal impeller is the angle that the blade trailing edge makes with a tangent to the impeller at the trailing edge. This angle is called the trailing edge angle. Forward-curved impeller blades are characterized by a trailing edge angle greater than 90 degrees, while backward-curved impeller blades are characterized by a trailing edge angle less than 90 degrees.

Figure 2:
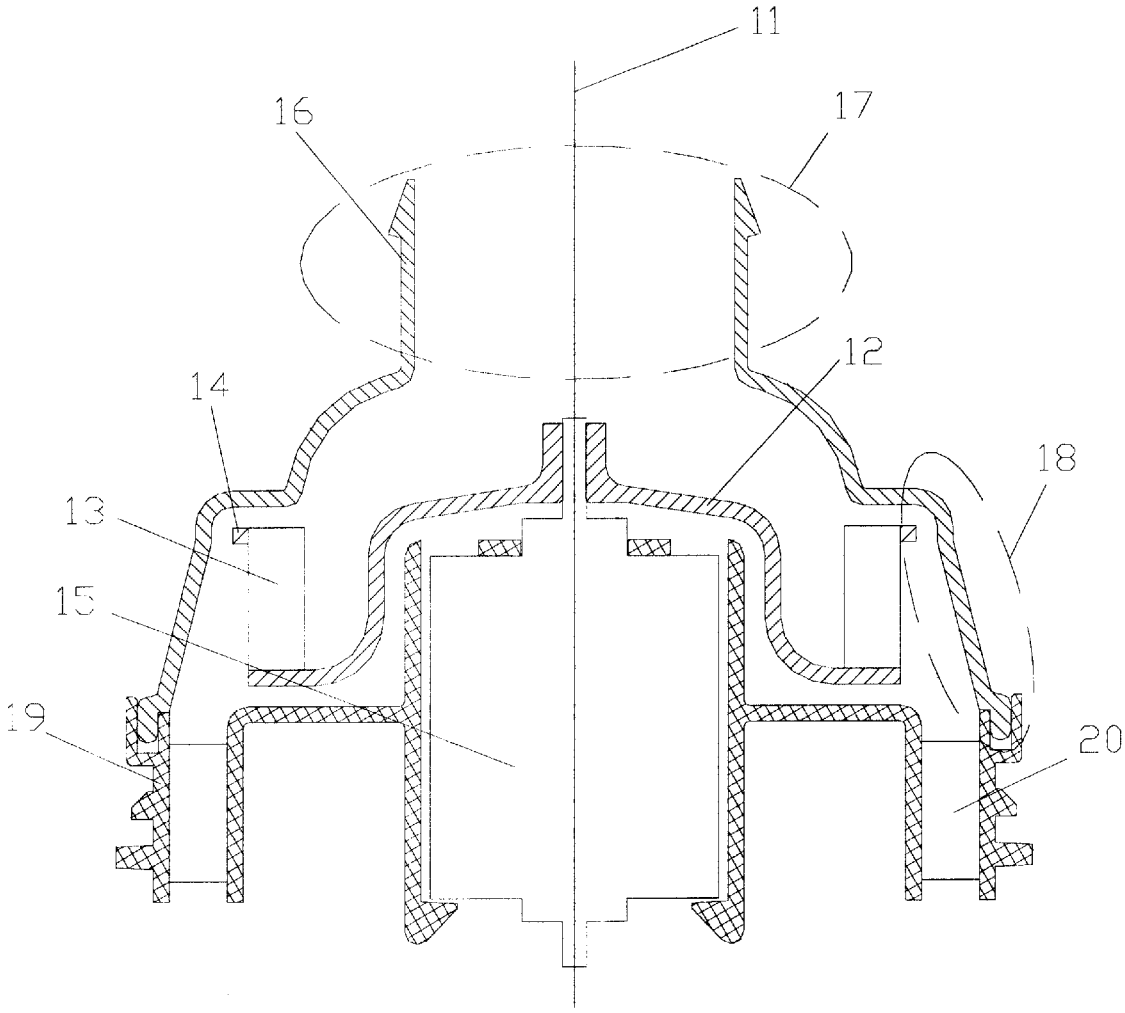
FIG. 2 is a cross section view of one embodiment of a blower, taken in a plane that contains the impeller axis. The cross section includes a swept view of an impeller blade, showing the minimum and maximum radial position of the blade as the impeller rotates, and a swept view of a stator blade, showing the axial position of the leading and trailing edges of the blade.

FIG. 2 is a cross section view of one embodiment of the blower, the cross section being in a plane that contains the impeller axis 11. The cross section includes a swept view of an impeller blade 13 and a stator blade 20. The impeller comprises a hub 12, the blades 13, and the impeller top ring 14. The impeller hub is designed to fit closely around the drive motor 15 in order to minimize the required package volume of the blower assembly. The impeller hub is shaped to allow at least 30% of the axial extent of the motor to fit inside the hub. The impeller can accommodate the space requirements of a direct-current, brushed motor. These low power motors are less expensive than brushless motors of comparable power output, but usually have a higher aspect ratio, where the aspect ratio is defined by the ratio of motor length to motor diameter. The drive motor 15 can be either of a brushed or a brushless design, but in preferred embodiments, the drive motor 15 is a direct-current brushed motor with a power input of less than 10 watts, and most preferably less than 5 watts.

The impeller blades 13 are forward-curved. Forward-curved blades work well at low Reynolds numbers because the pressure does not increase significantly within the blading. The short chord lengths of a forward-curved impeller also leave space inside the blading to accommodate a protruding hub. The shroud 16 includes an inlet section 17 that guides air into the impeller, and an outlet section 18 that forces the air leaving the impeller to turn from a generally radial and tangential direction to a generally axial and tangential direction and enter the stator. In preferred embodiments the inlet section is cylindrical and the axis of the cylindrical inlet is coincident with the axis of the impeller and motor. This alignment allows the inflow to be relatively uniform, which increases the efficiency and reduces the noise generated by the assembly. Also in preferred embodiments the outlet section of the shroud is linear in cross section, though elliptical or circular arc cross sections can also be used. The linear cross section is the simplest to design and construct, and consumes the smallest overall package volume.

The stator 19 provides structure to hold the motor 15, and provides the annular passage and stator blades 20 that turn and diffuse the flow, i.e., convert the kinetic energy associated with the tangential velocity component of the flow to potential energy, i.e., a static pressure rise. The blower assembly uses only one set of stator blades, to maximize the chord length of the stator within the overall package volume. The longer chord length allows more efficient turning and diffusion of the flow because of the larger Reynolds number associated with it. The blade chord length of the one stage stator is longer than what can be used in a two-stage stator of the same package volume. At stator blade outside diameters of approximately 150 millimeters the corresponding Reynolds number becomes large enough to consider the benefits of a two-stage stator.

Figure 3:
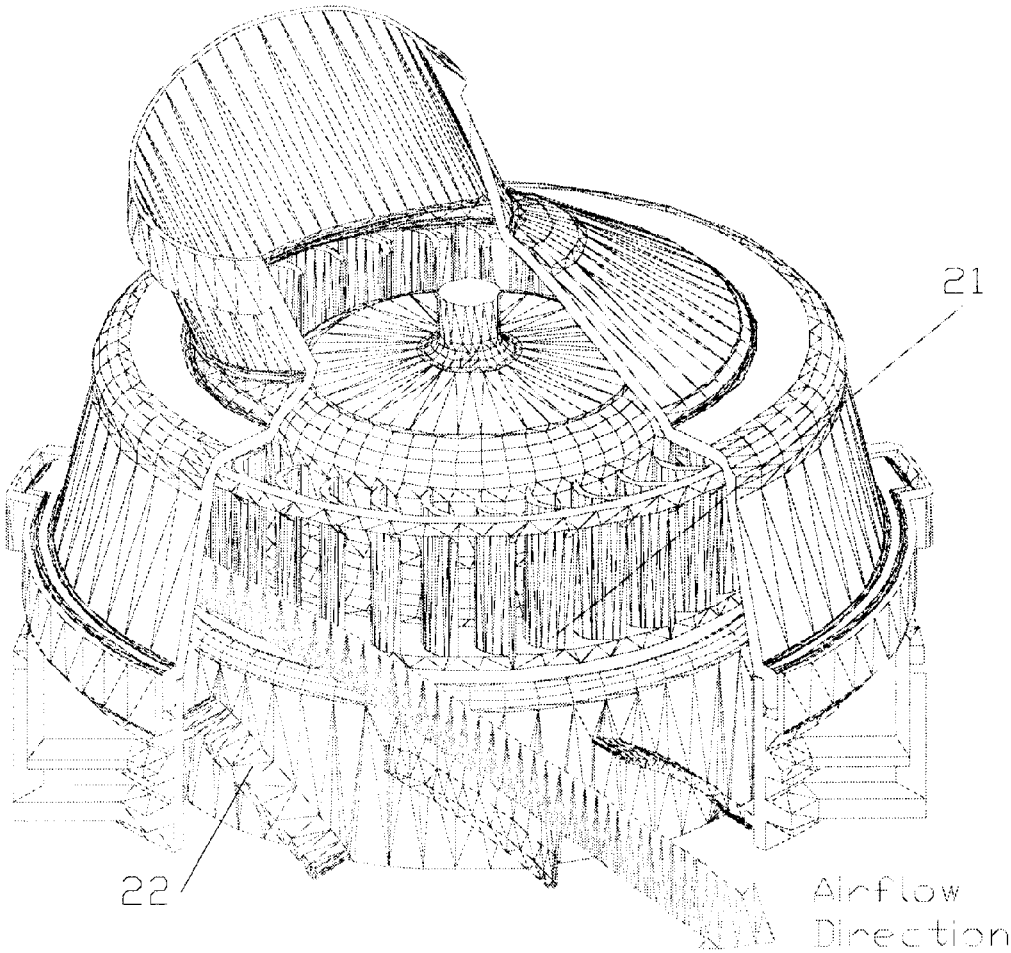
FIG. 3 is a cutout view of another embodiment of the blower. The view shows the shape of the impeller and stator blades, and the airflow direction through the stator.

FIG. 3 is a cutout view of another embodiment of the blower assembly, showing the shape of the impeller blades 21 and the stator blades 22. The stator blades turn the flow only partially; the flow retains a significant tangential component upon exiting the blower assembly. Conversion of a large fraction of the tangential velocity component into static pressure is not possible; the flow separates from the blades causing a reduction in static pressure development and a resulting loss of performance.

The above described blower assembly can be specifically designed to be positioned in the engine compartment of a vehicle, e.g. to cool electronic components in that compartment. It can also be used to cool electronic components in other applications such as computers.

A number of embodiments of the invention have been described. Nevertheless, it will be understood that various modifications may be made without departing from the spirit and scope of the invention.

What is claimed is:

1. A centrifugal blower assembly comprising an impeller, a stator, a shroud and a motor; said impeller comprising impeller blades and an impeller hub and being driven by said motor, said shroud comprising an inlet for the impeller; said stator and shroud functioning together to guide airflow exiting the impeller, to turn the airflow from a generally radial and tangential direction to a generally axial and tangential direction, and to guide the airflow through a set of stator blades; said centrifugal blower assembly being further characterized by:

a) said impeller blades being forward-curved;

b) said impeller hub covering at least 30% of the axial extent of the motor;

c) said stator comprising a single stage of stator blades within an annular flow passage;

d) said stator blades having a chord length at least 15% of the stator blade diameter;

e) said stator having a blade diameter of no more than 150 millimeters; and f) said motor having a power input of less than 25 watts.

2. The centrifugal blower assembly of claim 1 further characterized in that said stator comprises features to hold said motor in position without the use of additional fasteners.

3. The centrifugal blower assembly of claim 1 further characterized in that said motor is a direct-current brushed motor with a power input of less than 10 watts.

4. The centrifugal blower assembly of claim 1 further characterized in that said motor is a direct-current brushed motor with a power input of less than 5 watts.

5. The centrifugal blower assembly of claim 1 further characterized in that the outside diameter of the stator blades is less than 90 millimeters.

6. The centrifugal blower assembly of claim 1 further characterized in that the stator blade chord lengths are at least 20% of the stator blade diameter.

7. The centrifugal blower assembly of claim 1 further characterized in that said impeller, said stator, and said shroud are constructed from injection molded plastic.

8. The centrifugal blower assembly of claim 1, sized and designed for cooling electronic components.

9. The centrifugal blower assembly of claim 8, where said electronic components are positioned in an engine compartment of a vehicle.

10. A centrifugal blower assembly comprising an impeller, a stator, a shroud and a motor; said impeller comprising impeller blades and an impeller hub and being driven by said motor, said shroud comprising an inlet for the impeller; said stator and shroud functioning together to guide airflow exiting the impeller, to turn the airflow from a generally radial and tangential direction to a generally axial and tangential direction, and to guide the airflow through a set of stator blades; said centrifugal blower assembly being further characterized by:

a) said impeller blades being forward-curved;

b) said impeller hub covering at least 30% of the axial extent of the motor;

c) said stator comprising a single stage of stator blades within an annular flow passage;

d) said stator blades having a chord length at least 20% of the stator blade diameter;

e) said a stator having a blade diameter of no more than 90 millimeters;

f) said motor being a direct-current brushed motor with a power input of less than 5 watts;

g) said stator comprising features to hold said motor in position without the use of additional fasteners;

h) said impeller, said stator, and said shroud being constructed from injection molded plastic; and i) said blower assembly being sized and designed for cooling electronic components positioned in the engine compartment of a vehicle.

* * * * *